US006640813B2

(12) United States Patent
Raisner et al.

(10) Patent No.: US 6,640,813 B2
(45) Date of Patent: Nov. 4, 2003

(54) PORTABLE ACCESSORY BAG

(76) Inventors: Amy W. Raisner, 10 Northcliff Dr., West Hartford, CT (US) 06117; David H. Raisner, 10 Northcliff Dr., West Hartford, CT (US) 06117

( * ) Notice: Subject to any disclaimer, the term of this patent is extended or adjusted under 35 U.S.C. 154(b) by 46 days.

(21) Appl. No.: 10/016,148

(22) Filed: Dec. 10, 2001

(65) Prior Publication Data

US 2003/0106563 A1 Jun. 12, 2003

Related U.S. Application Data

(60) Provisional application No. 60/254,290, filed on Dec. 11, 2000, and provisional application No. 60/301,738, filed on Jun. 28, 2001.

(51) Int. Cl.[7] ..... A45D 33/28

(52) U.S. Cl. ..... 132/200; 132/295; 132/315; 206/581; 206/779

(58) Field of Search ..... 132/200, 312, 132/313, 314, 315, 316, 317, 75, 76.2, 76.5, 286, 289, 290, 291, 293, 294, 295, 297, 300, 301, 303, 309; 206/581, 235, 37, 38, 373, 823, 45.2, 779, 737, 734; 150/106, 112, 114, 117, 118; 190/114

(56) References Cited

U.S. PATENT DOCUMENTS

| | | | | | |
|---|---|---|---|---|---|
| 1,155,581 | A | * | 10/1915 | Kaiser | 206/479 |
| 1,160,866 | A | * | 11/1915 | Ehlert | 132/290 |
| 1,206,276 | A | * | 11/1916 | Wallach | 190/109 |
| 1,455,004 | A | * | 5/1923 | Kaufmann | 132/312 |
| 1,534,497 | A | * | 4/1925 | Boorman | 132/297 |
| 1,612,342 | A | * | 12/1926 | Alstrand | 150/113 |
| 1,785,609 | A | * | 12/1930 | Baumann | 150/119 |
| 2,000,302 | A | * | 5/1935 | Solomon | 132/312 |
| 2,168,073 | A | * | 8/1939 | Schinder | 132/315 |
| 2,247,320 | A | * | 6/1941 | Stanely | 150/119 |
| 2,321,807 | A | * | 6/1943 | Glickman | 132/312 |
| 2,353,932 | A | * | 7/1944 | Schaffer | 132/312 |
| 2,830,601 | A | * | 4/1958 | Pool | 132/312 |
| 2,874,707 | A | * | 2/1959 | Koppel | 132/315 |
| 4,192,329 | A | * | 3/1980 | Swearingen | 132/287 |
| 4,461,332 | A | | 7/1984 | Parkhurst | |
| 4,679,692 | A | * | 7/1987 | Davey | 206/581 |
| 4,815,608 | A | * | 3/1989 | Silberberg | 132/295 |
| 4,824,143 | A | * | 4/1989 | Grainger | 283/56 |
| 4,960,204 | A | | 10/1990 | Young et al. | |
| 5,638,955 | A | * | 6/1997 | Calciano | 206/320 |
| 5,655,553 | A | * | 8/1997 | Giese et al. | 132/303 |
| 5,743,500 | A | * | 4/1998 | Northway et al. | 248/146 |
| 5,878,757 | A | * | 3/1999 | Hernandez | 132/287 |
| 5,913,312 | A | * | 6/1999 | Donnell | 132/73 |
| 6,095,058 | A | * | 8/2000 | Earnhart | 108/43 |
| 6,109,442 | A | | 8/2000 | Roegner | |
| 6,223,754 | B1 | * | 5/2001 | Burdi et al. | 132/300 |
| 6,349,729 | B1 | * | 2/2002 | Meyer et al. | 132/73.5 |

OTHER PUBLICATIONS

"The Go–Anywhere Make–up Vanity", Hammacher Schlemmer, Skymall Catalog, p. 23.

* cited by examiner

*Primary Examiner*—Eduardo C. Robert
*Assistant Examiner*—David Comstock
(74) *Attorney, Agent, or Firm*—Cantor Colburn LLP

(57) ABSTRACT

An accessory bag is disclosed having a lower surface, side surfaces, the side surfaces and the lower surface forming a compartment area. A rest area is provided within the compartment area for at least partially securing an accessory item in a desired orientation. A cover is associated with one of the side surfaces. The cover includes an open region for forming a hole through the cover. The rest area is accessible through the open region when the cover is in a closed position.

18 Claims, 5 Drawing Sheets

PORTABLE ACCESSORY BAG

CROSS REFERENCE TO RELATED APPLICATIONS

This application claims the benefit of U.S. Provisional Application No. 60/254,290, filed on Dec. 11, 2000 and U.S. Provisional Application No. 60/301,738, filed on Jun. 28, 2001.

TECHNICAL FIELD

This invention relates generally to an accessory bag. More particularly, this invention relates to an accessory bag for holding and assisting in the utilization of nail polish or other cosmetic items.

BACKGROUND

Accessory bags, such as cosmetic cases and handbags, for carrying accessories such as cosmetic articles are provided in a wide variety of shapes, styles, and internal arrangements. In general, these bags are designed to store and/or carry accessories, cosmetic articles, and containers. Some of these bags constitute nothing more than a flexible receptacle or container, into which the accessories or other items are dropped. These bags can be quite lumpy and the items placed inside tend to become jumbled. Other accessory bags or cases have been adapted to hold articles in a pre-arranged array. While such bags help to organize one's accessories and articles, the pocket arrangement of such bags is seldom perfectly suited for the bag user's own items. Furthermore, while both types of bags are able to store accessories, or enable the owner to carry the accessories, these types of bags do not assist the owner in actually using the contained accessories.

SUMMARY

Disclosed herein is an accessory bag. In an exemplary embodiment, the accessory bag includes a lower surface and side surfaces, the side surfaces and the lower surface forming a compartment area. A rest area is provided within the compartment area for at least partially securing an accessory item in a desired orientation. A cover is associated with one of the side surfaces. The cover includes an open region for forming a hole through the cover. The rest area is accessible through the open region when the cover is in a closed position.

The above described and other features are exemplified by the following figures and detailed description.

DRAWINGS

Referring to the exemplary drawings wherein like elements are numbered alike in the several FIGS.:

DETAILED DESCRIPTION

Figure 1:
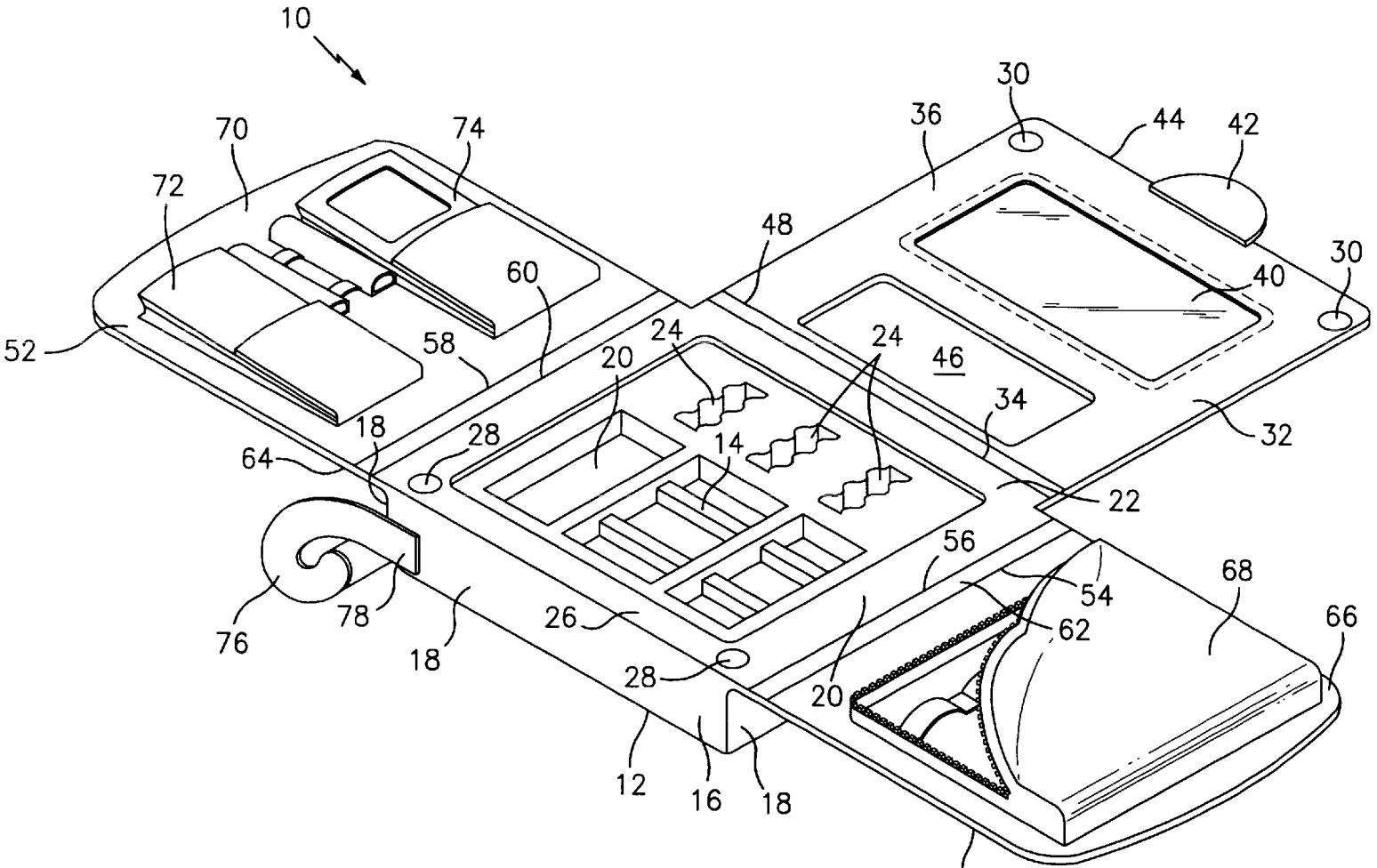
FIG. 1 is a front perspective view of an accessory bag.

Referring to FIG. 1, an accessory bag 10 is shown having a lower surface 12 below a compartment area 14. The compartment area 14 may be held within a base section 16 of the accessory bag 10, the base section 16 defined by the lower surface 12 and sides 18. The compartment area 14 may include a selection of divided compartments 20. Three rectangular shaped compartments 20 are shown, two of which are further divided into even smaller compartments. While a specific arrangement of compartments 20 is shown, it is within the scope of this invention to provide alternate compartment shapes and sizes. The compartment area 14 is preferably formed from a shape retaining material. That is, the compartment area 14 is preferably substantially rigid so as to provide the rigidity necessary for retaining elements therein and for providing a solid base for a working surface which will be further described below. The compartment area 14 may be formed from a solid material, such as plastic, alternatively the compartment area 14 may be formed from a sheet of foam material in which the compartments 20 are cut out from. If the compartment area 14 is made of plastic, the compartments 20 may be lined with a foam material or other insulating or soft material to reduce the noise and provide some protection to the accessories contained therein.

As a further part of the compartment area 14, there is preferably a flexible rest area 22. The rest area 22 is preferably made of a lightweight, resilient material, such as contoured foam, and may include opening shapes 24 as shown. The opening shapes 24 are preferably sized to snugly receive a cosmetic item such as a nail polish bottle. While the opening shapes 24 may be sized to received the cosmetic item in a lying down position, that is, with an opening of the cosmetic item facing a side 18 of the accessory bag 10, the opening shapes 24 are preferably sized such that the cosmetic item may stand upright in the accessory bag 10, and may be securely held in that upright position, or even in a tilted position, as will be further discussed below.

The base section 16 includes an upper surface 26 which is opposite, and may be substantially parallel to, the lower surface 12. The upper surface 26 may include one or a plurality of first fastening devices 28. The first fastening devices 28 may cooperate with ore or a plurality of second fastening devices 30 which are provided on a cover 32. The first and second fastening devices 28, 30 may include hook and loop type fasteners, snaps, and magnets. The use of other types of fastening devices is within the scope of this invention.

The cover 32 is preferably a substantially planar cover with a periphery sized to substantially cover the upper surface 26 of the base section 16. The cover 32 is preferably hinged to the base section 16 at an intersection of the upper surface 26 and one of the sides 18. The hinge 34 is preferably a living hinge, that is, a flexible length of material which connects the cover 32 to the base section 16. Alternatively, such a length of material may be part of the material which forms the cover 32 or part of the material which forms the base section 16, or the cover 32 and the base section may be made from the same stretch of material in which case the hinge 34 would be defined by the intersection of the upper surface 26 and the cover 32. In still another embodiment, the hinge 34 could include hardware which allows the cover 32 to open and close with respect to the base section 16.

Figure 2:
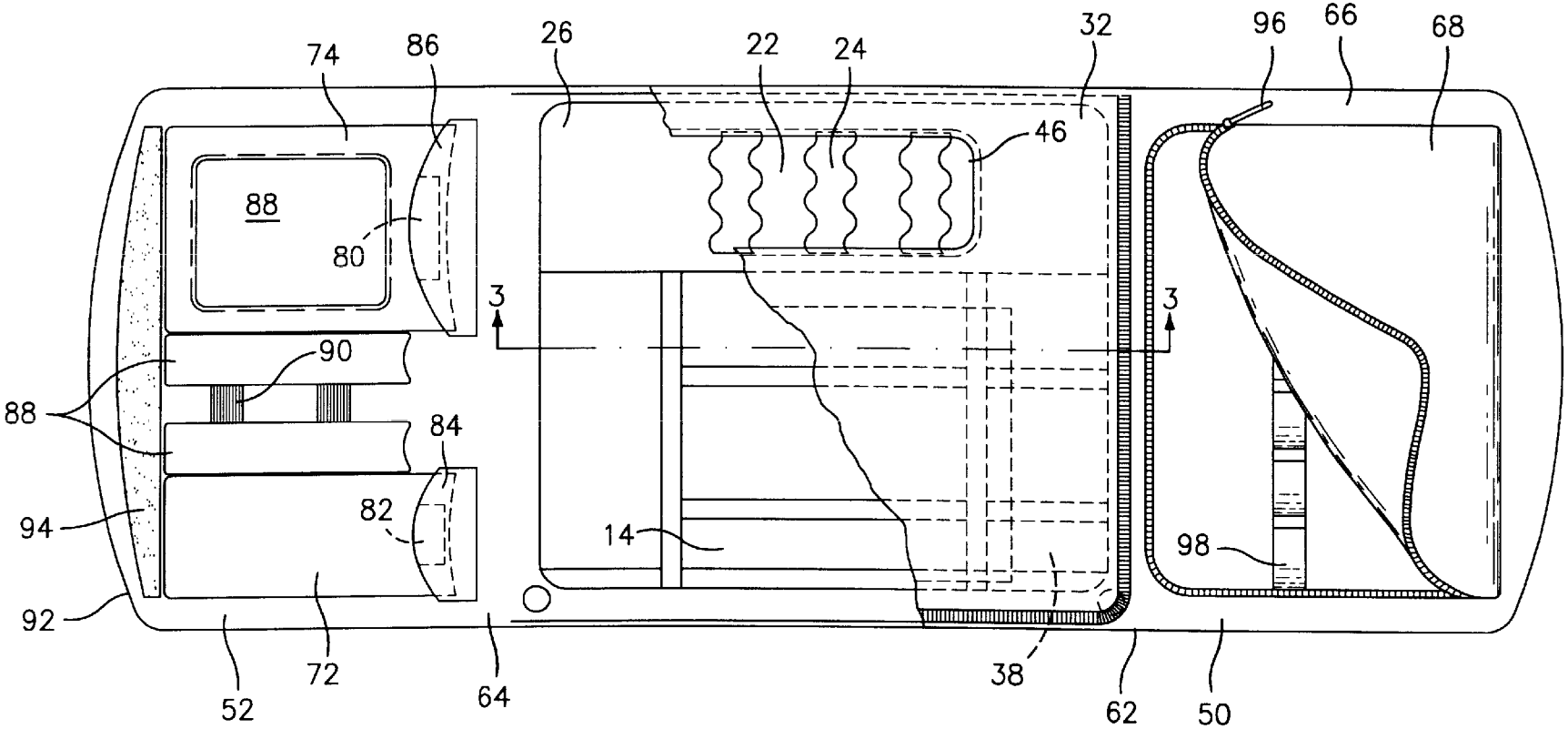
FIG. 2 is a top perspective view of the accessory bag of FIG. 1.

The cover 32 includes an inner surface 36 and an outer surface 38 (FIG. 2). The inner surface 36 includes the second fastening devices 30 and may further include a mirror 40. A third fastening device 42 may be positioned along a free edge 44 of the cover 32. The free edge 44 of the cover 32 is opposite the edge of the cover 32 which includes the hinge 34. The third fastening device 42 may be used in addition to the first and second fastening devices 28, 30, or may be used in lieu of the first and second fastening devices 28, 30. As with the first and second fastening devices 28, 30, the third fastening device 42 may comprise hook and loop type fastening means, snap means, magnet means, or other fastening means available. The third fastening device 42 may cooperate with a complimentary fastening device positioned on the base section 16, such as on a side 18 adjacent the free edge 44 of the cover 32 in the closed position.

The cover 32 further preferably includes an opening 46 adjacent the hinged edge 48. The opening 46 passes through the inner surface 36 and the outer surface 38 of the cover 32. In an open position of the cover 32, as shown in FIG. 1, the compartment area 14 as well as the flexible rest area 22 is made accessible to the user. In a closed position of the cover 32, as shown in FIG. 2, the cover 32 hides the compartments 20, but the rest area 22 and the opening shapes 24 are still accessible through the opening 46 in the cover 32. The outer surface 38 is preferably substantially parallel with the lower surface 12 of the base section 16 in this closed position. Thus, in this closed position of the cover 32, a user could use the outer surface 38 of the cover 32 as a work surface while open bottles of cosmetics, such as nail polish, are held securely within the rest area 22. The cover 32 is thus preferably formed from a substantially rigid material for enabling it to be used as a work surface. For example, the cover 32 may include a cardboard or plastic interior with a soft material outer covering, such as fabric or leather. It should further be noted that the cover 32 in the closed position occupies substantially the same peripheral boundaries as does the base section 16 and thus using the accessory bag 10 as a work surface and holder occupies a limited amount of space. The compact nature of the accessory bag 10 can enable its use on a lap or in another small work area. The compartment area 14 preferably provides rigidity to the accessory bag 10 so that it may be utilized on a lap without having the base section 16 bending undesirably during use.

As an additional feature of the accessory bag 10, the base section 16 may be attached to side storage flaps 50, 52. First side storage flap 50 may include a hinged edge 54 attached to first side edge 56 of the upper surface 26. Similarly, second side storage flap 52 may include a hinged edge 58 attached to second side edge 60 of the upper surface 26. Hinges 62 and 64 may be provided adjacent the first side storage flap 50 and the second side storage flap 52, respectively, and may be living hinges similar to that described with respect to hinge 34 or hardware type hinges.

The first side storage flap 50 is shown to have an inner surface 66 including a zippered storage pouch 68. The second side storage flap 52 is shown to have an inner surface 70 having a pair of fastenable pockets 72, 74. The storage pouch 68 and the pockets 72, 74 may include additional implements, cosmetics, or accessories for the user of the accessory bag 10.

As further shown in FIG. 1, the accessory bag 10 may include a carrying strap 76. The carrying strap 76 may be of a length to allow a hand-held carry of the accessory bag 10, or, alternatively, the carrying strap 76 may be long enough to allow the accessory bag 10 to be carried in an over the shoulder fashion. In a separate embodiment, both types of straps may be included with the accessory bag 10. Additionally, the carrying strap 76 may include an adjustable section 78 which allows the end of the carrying strap 76 to occupy varying positions along the side section 18 to which the adjustable section 78 is attached. Varying the position of adjustable section 78 along side section 18 varies the overall length of the carrying strap 76.

Turning now to FIG. 2, additional details of the pockets 72, 74 are shown. The pockets 72, 74, may include fasteners 80, 82 positioned beneath a closeable flap 84, 86. The pocket 74 may include a window 88 so that the contents of the pocket 74 may be viewed without opening the flap 86. Alternatively, the entire pocket 74 may be transparent for providing a full view of the contents. It is within the scope of this invention to provide windows on any or all of the other pockets of the accessory bag 10, or that any or all of the pockets be made of a transparent material. The second side storage flap 52 may additionally include smaller open sided pockets 88 and elastic straps 90 interconnecting the pockets 88. Both the pockets 88 and straps 90, as shown, are sized to accept emery boards or nail files, although other implements and accessories may be stored therein. The free edge 92 of the second side storage flap 52 may include a fastening device 94 positioned on the inner surface 70 of the second side storage flap 52. A complimentary fastening device may be positioned on an outer surface (not shown) of the first side storage flap 50 for securing the first and second side storage flaps 50, 52 over the base section 16.

The zippered pouch 68 on the first storage flap 50 includes a zipper 96 which preferably runs along three sides of the pouch 68 so that complete access can be obtained into the interior of the pouch 68. Within the pouch 68, several divided sections of elastic 98 are shown secured upon the inner surface 66. Thus, some items placed within the pouch 68 may be slid behind the elastic 98 for securement between the elastic 98 and the inner surface 66. Once the zipper 96 is completely zipped, the contents within the pouch 68 are securely contained therein.

With the first and second side storage flaps 50, 52 in an open configuration, the contents within the compartment area 14 may be accessed. FIG. 2 shows a partial cut-away view of the cover 32 overlying the upper surface 26. With the cover 32 in an open position, the compartments 20 are accessible, but with the cover 32 in a closed position, the compartments 20 are hidden. On the contrary, the rest area 22 is accessible in both the open and the closed positions of the cover 32. As shown in FIG. 2, the openings 24 of the rest area 22 may include contoured peripheries, such as the serpentine peripheries shown, for securing an open bottle in an upright position.

Figure 3:
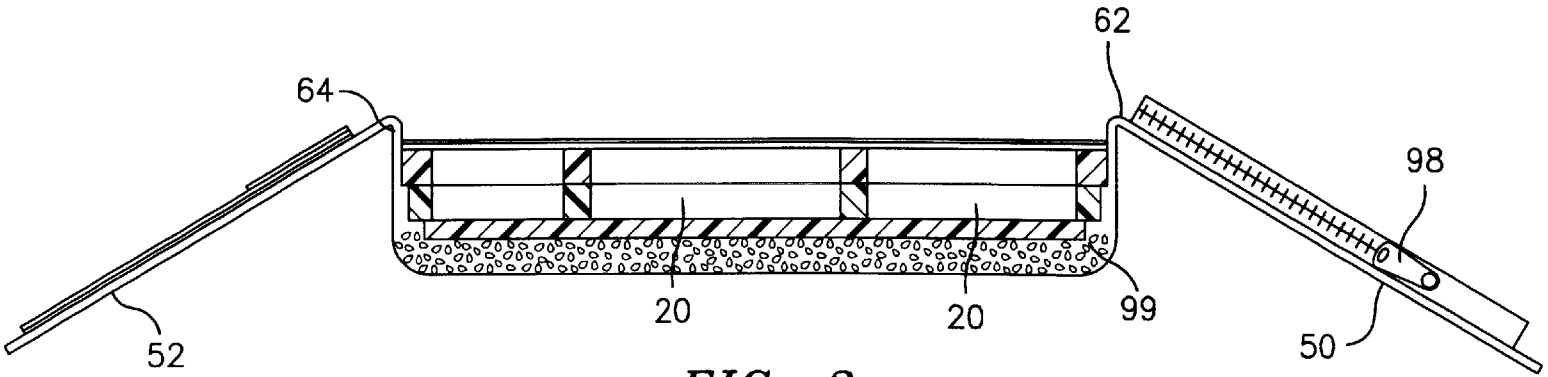
FIG. 3 is side cross-sectional view of the accessory bag of FIG. 1 taken along line 3—3 in FIG. 2.

Turning now to FIG. 3, the lower surface 12 of the base section 16 is shown to house beanbag type filling 99. Such filling 99 allows the accessory bag 10 to be placed comfortably on a user's lap. Any pellet-sized fillings could be used within the base section 16 that moves around within the base section 16 for conforming to the user's lap. Alternatively, the filling could include a sheet of cushioning foam material. Also, because the first and second side storage flaps 50, 52 are placed on opposite sides of the base section 16, the accessory bag 10 can be evenly balanced when placed on the user's lap and opened up. With the cover 32 in the closed position, the user can use the outer surface of the cover 32 as a workstation while accessing open bottles of cosmetics, such as nail polish, from the rest area 22. The shape retaining material used in the base section 16, such as the compartment area 14, provides the necessary rigidity to the accessory bag 10 to be used on a lap. Thus, an evenly balanced, comfortable workstation is provided to the user with no need for a table, although use on a table is also within the scope of this invention.

Also as shown in FIG. 3, the sides 18 of the base section 16 extend an additional height above the upper surface 26 so that ample room may be provided for folding the cover 32 and the first and second side storage flaps 50, 52 within the confines of the accessory bag 10.

Figure 4:
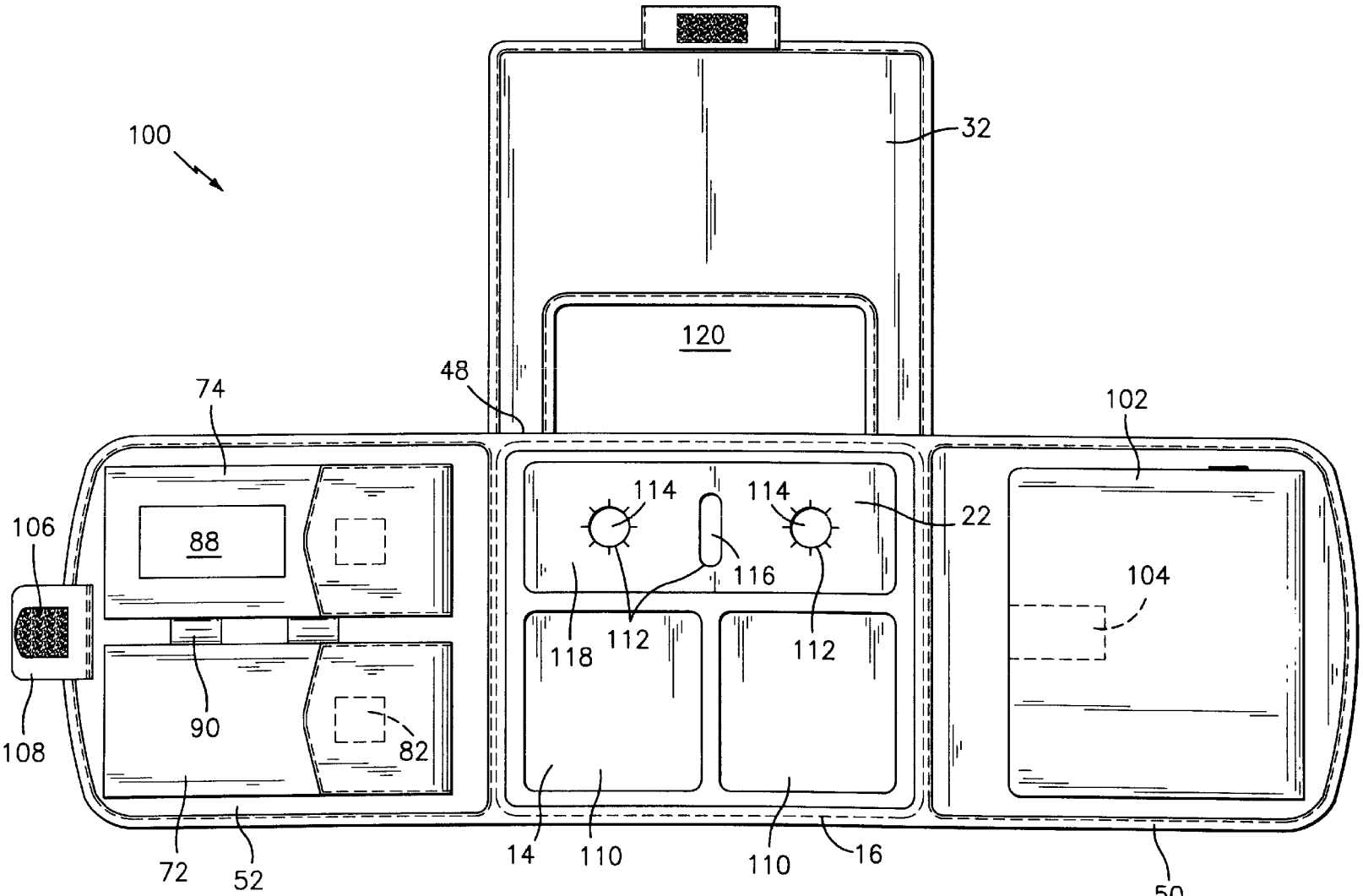
FIG. 4 is a partial top plan view of an alternate embodiment of an accessory bag.

Turning now to FIG. 4, a modified accessory bag 100 is shown. The accessory bag 100 includes a base section 16, first and second storage flaps 50, 52, and cover 32 as does the accessory bag 10, however, certain aspects of these items are different as will be described. While the first storage flap 50 includes a storage area 102, it is a pocket with a fastener 104, such as a hook and loop type fastener, rather than a zipper. While the second storage flap 52 includes the pockets 72, 74, they are sized larger than in the accessory bag 10 such that the open-ended pockets 88 are not employed. A fastening device 106 is provided on a smaller flap 108 attached to the second side storage flap. The fastening device 106 preferably cooperates with a complimentary fastening device (not shown) provided on an outer surface of the first side storage flap 50. The base section 16 of accessory bag 100 includes a compartment area 14, but the compartments 110 are sized larger than the compartments 20 of the accessory bag 10. A rest area 22, preferably made of foam, is again included within the compartment area 14, but the openings 112 are shown to include two circular openings 114 and an oval opening 116. The circular openings 114 may include radially projecting lines 118 cut into the rest area material for accepting a wide range of bottle sizes. The oval opening 116 is provided for retaining oval shaped bottles or bottles having a substantially rectangularly shaped cross-section. Although foam is described as the preferred material for the rest area, other materials and devices which would retain a bottle in an upright configuration would be within the scope of this invention. The cover 32 includes an opening 120 which extends all the way to the hinged edge 48 of the cover 32, although an opening such as opening 46 is also within the scope of this invention.

Figure 5:
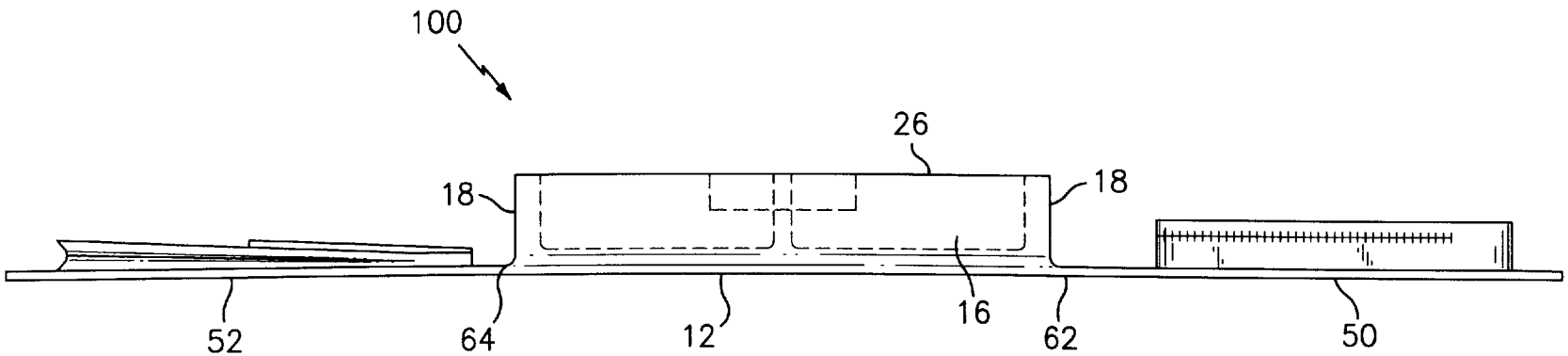
FIG. 5 is a side plan view of the accessory bag of FIG. 4.

As shown in FIG. 5, the first and second side storage flaps 50, 52 are connected to the base section 16 via hinges 62, 64 as in the accessory bag 10, however the hinges 62, 64 are located adjacent the lower surface 12 of the base section 16 in the accessory bag 10. The first and second side storage flaps 50, 52 include sufficient material for folding the flaps 50, 52 up and over the upper surface 26 of the base section 26. A material may be provided over the hinges which covers the hinges 62, 64 and connects the cover 32 and flaps 50, 52 to the top edges of the compartment area 14. Also as shown in FIG. 5, the lower surface 12 does not include beanbag filling, which thus decreases the cost of manufacturing accessory bag 100.

Figure 6:
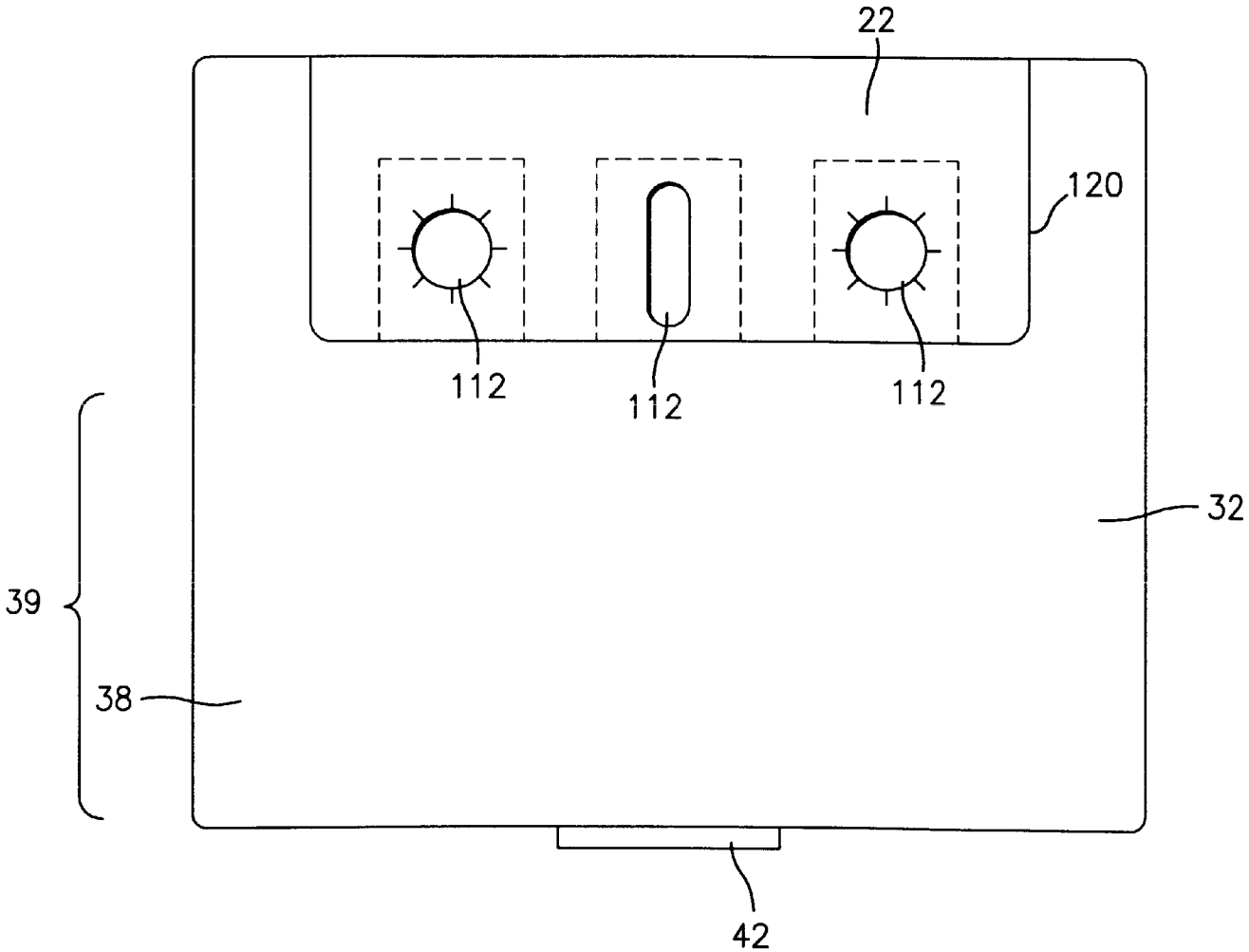
FIG. 6 is a partial top plan view of the accessory bag of FIG. 4 with the cover in a closed position.

FIG. 6 exemplifies a closed position of the cover 32, showing the outer surface 37 hiding the base section 16 from view except for what is visible through the opening 120, namely the rest area 22 and associated accessory openings 112. For simplicity, the first and second side storage flaps 50 and 52 are not shown. It can be seen in FIG. 6 that with the cover 32 in the closed position, the outer surface 38 includes a usable work area 39, with the necessary implements being positioned securely above the work area 39.

In use, the accessory bag 100 may be employed in the same manner as the accessory bag 10. That is, accessories, implements, cosmetics, and other items may be stored within the storage area 102, pockets 72, 74, and compartments 110. Open bottles of cosmetic materials that are subject to spillage upon tipping, such as nail polish, may be secured in an upright open configuration within the rest area 22. With the cover 32 in a closed position, a user may work upon the outer surface of the cover 32 while accessing the open bottles securely maintained within the rest area 22 and extending through the opening 120.

Thus, a portable accessory bag has been described which is configured to hold nail polish or other cosmetic items, including but not limiting to, finger nail accessories. The bag configuration permits nail polish to be held stationary at upright or tilted angles without spilling. In an exemplary embodiment, the accessory bag includes a lower surface and a compartment having sides. The compartment includes a cover having an outer surface. The flat surface of the outer surface includes at least one open region that is configured such that a bottle of nail polish or other cosmetic item or accessory to extends from the compartment through the cover. The open region may be a single opening through the material of the cover. The cover is joined to the accessory bag along a single edge and is configured such that it will easily pivot away from the compartment to provide easy access thereto. The secured cosmetic item extends from a rest situated in the compartment through the open region and protrudes above the surface of the cover when the cover is in place over the compartment. The rest (in one exemplary embodiment the rest is a foam rest) cradles at least a portion of the cosmetic item to secure it in a particular orientation. The outer surface of the cover is shown as having a flat configuration, however any configuration is contemplated provided that such configuration permits a user to at least partially brace and steady a user's hands and/or fingers. The stability provided by such a configuration is desirable for cosmetic purposes, e.g., polishing of fingers nails.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of manicuring nails, the method comprising:

providing an accessory bag, the accessory bag having a base section with a shape retaining compartment area and a rest area, the rest area including a resilient retaining material, the accessory bag further having a cover pivotally secured to the base section, the cover having an opening and a flat outer surface;

moving the cover to an open position;

removing a bottle of nail polish from the compartment area;

moving the cover to a closed position;

pushing the bottle through the opening in the cover and into the rest area;

securely retaining the bottle in an upright configuration within the resilient retaining material; and, working upon the flat outer surface of the cover to complete a manicure.

2. The method of claim 1 wherein the accessory bag further comprises first and second side storage flaps attached to opposite sides of the base section, the method further comprising accessing manicuring implements from the storage flaps.

3. The method of claim 1 further comprising placing the base section of the accessory bag on a lap for completing the manicure.

4. The method of claim 1 further comprising, upon completion of the manicure, moving the cover to an open position, storing the nail polish within the compartment area, and moving the cover to a closed position.

5. An accessory bag comprising:

a lower surface;

a plurality of side surfaces, the plurality of side surfaces and the lower surface forming a compartment area;

a rest area within the compartment area the rest area including a resilient material having at least one opening formed therein, for at least partially securing a bottle in a upright position; and, a cover associated with pivotally joined along a hinged edge of the cover to one of the side surfaces, the cover further including a free edge, the cover including an open region, the open region forming a hole through the cover, the open region larger in size than the at least one opening in the rest area;

wherein the at least one opening in the area is accessible through the open region when the cover is in a closed position, and wherein a bottle secured in the at least one opening may be removed through the open region, and wherein, with the cover in the closed position, the cover is substantially parallel to the lower surface and a work surface is defined between the open region and the free edge of the cover.

6. The accessory bag of claim 5 wherein the open region is formed adjacent the hinged edge of the cover and elongated in a direction parallel with the hinged edge of the cover.

7. The accessory bag of claim 5, further comprising a side storage flap pivotally associated with one of the side surfaces perpendicular to the side surface to which the cover is pivotally joined.

8. The accessory bag of claim 7 further comprising a windowed pocket and elastic retaining devices on the side storage flap.

9. The accessory bag of claim 5 further comprising compartments within the compartment area, wherein the cover is movable between an open position and a closed position, and wherein the compartments arc covered when the cover is in the closed position.

10. The accessory bag of claim 5 further comprising a strap having ends, each end attached to a side surface of the accessory bag.

11. The accessory bag of claim 5 further comprising a cushioning filling between the lower surface and the compartment area.

12. The accessory bag of claim 5, wherein the resilient material comprises a contoured foam material.

13. The accessory bag of claim 12 wherein the contoured foam material includes two circular openings and an oval opening.

14. The accessory bag of claim 5 wherein the at least one opening has radial slits extending into the resilient material.

15. The accessory bag of claim 5 wherein the compartment area is made of a shape retaining and substantially rigid material.

16. The accessory bag of claim 15 further comprising compartments within the compartment area and a cushioning material secured to a bottom interior of the compartments.

17. The accessory bag of claim 5, wherein the cover includes a flat, substantially rigid outer surface.

18. An accessory bag comprising:

a lower surface;

a plurality of side surfaces, the plurality of side surfaces and the lower surface forming a shape retaining compartment area;

a rest area within the compartment area for at least partially securing an accessory item in a desired orientation, the rest area from foam material and including openings, each opening for receiving an accessory item, a distance from a first opening the rest area to a last opening in the rest area defining a first length;

a substantially rigid cover pivotally secured to one of the side surfaces, the cover movable between an open position and a closed position, the cover including an open region, the open region forming a hole through the cover, the open region having a second length greater than the first length, wherein the openings are accessible through the open region when the cover is in the closed position; and, first and second side storage flaps pivotally secured to first and second side surfaces of the accessory bag.

* * * * *